US007228096B2

(12) United States Patent
Yamada

(10) Patent No.: US 7,228,096 B2
(45) Date of Patent: Jun. 5, 2007

(54) PAPER EJECTION GUIDE OF FIXING MECHANISM FOR IMAGE FORMING APPARATUS HAVING SIMPLE JAM CLEARING STRUCTURE

(75) Inventor: Masamichi Yamada, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/151,204

(22) Filed: Jun. 14, 2005

(65) Prior Publication Data

US 2005/0276638 A1 Dec. 15, 2005

(30) Foreign Application Priority Data

Jun. 14, 2004 (JP) ..... 2004-175551

(51) Int. Cl.
*G03G 15/20* (2006.01)

(52) U.S. Cl. ..... 399/323

(58) Field of Classification Search ..... None
See application file for complete search history.

(56) References Cited

U.S. PATENT DOCUMENTS

| | | | | |
|---|---|---|---|---|
| 6,088,558 | A | 7/2000 | Yamada et al. | |
| 6,091,926 | A | 7/2000 | Yamada | |
| 6,351,619 | B1 | 2/2002 | Yamada | |
| 6,522,858 | B1 * | 2/2003 | Morganti et al. | 399/323 |
| 6,553,204 | B1 | 4/2003 | Yamada | |
| 6,577,840 | B2 | 6/2003 | Hachisuka et al. | |
| 6,658,229 | B2 * | 12/2003 | Ando et al. | 399/323 |
| 6,813,464 | B2 * | 11/2004 | Amita et al. | 399/323 |
| 6,865,363 | B2 | 3/2005 | Hachisuka et al. | |
| 2003/0215270 | A1 | 11/2003 | Yamada | |

FOREIGN PATENT DOCUMENTS

| | | |
|---|---|---|
| JP | 05-165364 | 7/1993 |
| JP | 08/220923 | 8/1996 |
| JP | 09-160426 | 6/1997 |
| JP | 2002-145503 | 5/2002 |
| JP | 2003-255750 | 9/2003 |

OTHER PUBLICATIONS

Computer translation of cited reference JP09-160426a.*

* cited by examiner

*Primary Examiner*—Quana Grainger
(74) *Attorney, Agent, or Firm*—Oblon, Spivak, McClelland, Maier & Neustadt, P.C.

(57) ABSTRACT

An image forming apparatus including an image forming mechanism forming a toner image on a recording sheet and a fixing mechanism. The fixing mechanism includes a pair of rotating members forming a nip portion and fixing the toner image onto the recording sheet with the nip under pressure and heat, and an ejection guide member swinging relative to the fixing mechanism. The fixing mechanism further includes a plurality of separation pawl members turning about a rotating shaft, a bracket having an elastic member, a pawl stopper, and a supporting shaft configured to support the bracket. The stopper pawl further includes a pressing member and a lever moving to allow the stopper to turn. The supporting shaft further includes a center axis about which the bracket is freely pivotable.

15 Claims, 11 Drawing Sheets

PAPER EJECTION GUIDE OF FIXING MECHANISM FOR IMAGE FORMING APPARATUS HAVING SIMPLE JAM CLEARING STRUCTURE

CROSS-REFERENCE TO RELATED APPLICATIONS

The present application is based on and claims priority to Japanese patent application No. JPAP 2004-175551 filed on Jun. 14, 2004 in the Japan Patent Office, the entire contents of which are incorporated herein by reference.

BACKGROUND OF THE INVENTION

1. Field of the Invention

The present invention relates to a method and apparatus for forming an image. More particularly, the present invention relates to a method and apparatus for forming an image having a device capable of effectively fixing the image with reduced assembling steps and simple jam clearing operation.

2. Description of the Related Art

Related art image forming apparatuses that use toner to form a visualized image are equipped with a fixing device for fixing a toner image on a recording medium. The fixing device includes a fixing roller or a fixing belt, a pressure roller or a pressure belt, and a nip part, so that the toner held on the recording medium is melt and fixed on the recording medium with pressure. The toner typically includes resin, which melts at the nip part. As a result, the toner tends to adhere to the fixing roller or the fixing belt. Therefore, various countermeasures are taken in order to prevent the toner from adhering to the surface of the fixing roller or the fixing belt.

In addition, related art image forming apparatuses are provided with a sheet separation mechanism having separation pawls that allow the sheet, which tends to wind around the fixing roller or the fixing belt due to molten toner, to forcibly separate from the fixing roller or the fixing belt. However, the separation pawls do not completely prevent the sheet from winding around the fixing roller or the fixing belt. In addition, when a jam caused by a wound sheet occurs, removal of the sheet is difficult. When a user removes the sheet in a condition in which the separation pawls are in contact with the roller, the sheet is torn and the torn sheet remains, which makes removal of the torn sheet difficult.

As one countermeasure for such a disadvantage, a mechanism is known in which the separation pawls are released from the fixing roller or the fixing belt when the user removes a jammed sheet. In order to provide such a mechanism, the separation pawls are formed on a unit capable of being released from the nip part. Each separation pawl includes a pawl part and a rotation shaft, and the pawl part is biased by a spring, so that the pawl part pivoting around the rotation shaft is in contact with a surface of the fixing roller or the fixing belt. As a result, when the unit is released from the nip part while dealing with the jam, this release causes absence of the fixing roller or the fixing belt that normally serves as a counterpart for the separation pawls to be in contact therewith, and the absence of this counterpart further causes the separation pawls to pivot too far inward in a direction of the fixing roller or the fixing belt. When closing and locking the unit after removing the jammed sheet, the separation pawl remains in a condition in which the separation pawl is pivoted too far, and thus the tips of the separation pawls stick into the surface of the fixing roller or the fixing belt and damage the surface thereof.

To prevent the above disadvantage from occurring, upon releasing to open the unit or closing to lock the unit, a mechanism for separating the separation pawls from the fixing roller or the fixing belt is known. A technique associated with a fixing device having such a separation mechanism has a structure as follows. Namely, each of a plurality of separation pawls includes an elastic member so that the separation pawls are forcibly separated from the fixing roller or the fixing belt. When releasing the unit, the elastic member is separated from a regulation member to forcibly separate the separation pawl from the fixing roller or the fixing belt, and when locking the unit after dealing with the jammed sheet the regulation member causes the elastic member to regulate the separation pawl so as not to damage the surface of the fixing roller or the fixing belt However, a separation pawl mechanism, which brings the separation pawls close to the surface or separating the separation pawls from the surface, regulates each of the plurality of separation pawls, respectively. Accordingly, the number of parts increases which results in an increase in the number of assembly processes when assembling the fixing device. In addition, when doing maintenance, there is a disadvantage that a lot of time is required to replace the separation pawls.

SUMMARY OF THE INVENTION

The present invention has been made in view of the above-mentioned and other disadvantages to address the above-discussed and other disadvantages.

One object of the present invention is to provide an image forming apparatus having a fixing device capable of being easily assembled. Another object of the present invention is to provide an image forming apparatus having a fixing device with high maintenance ability. In addition, yet another object of the present invention is to provide an image forming apparatus having a fixing device with a high capability in removing a jammed sheet.

The present invention advantageously provides a novel image forming apparatus which includes an image forming mechanism forming a toner image on a recording sheet and a fixing mechanism. The fixing mechanism includes a pair of rotating members forming a nip portion and fixing the toner image onto the recording sheet with the nip under pressure and heat, and an ejection guide member swinging relative to the fixing mechanism. The fixing mechanism further includes a plurality of separation pawl members turning about a rotating shaft, a bracket having an elastic member, a pawl stopper, and a supporting shaft configured to support the bracket. The pawl stopper further includes a pressing member and a lever moving to allow the pawl stopper to turn. The supporting shaft further includes a center axis about which the bracket is freely pivotable.

In the novel image forming apparatus, first, the ejection guide member is moved close to the nip portion, and then the tips of the plurality of separation pawl members are pressed to a surface of one of the pair of rotating members by swinging the ejection guide member. As a result, the pawl stopper is engaged with an engaging portion of the fixing mechanism in response to a motion of the lever in a fixing process. In addition, the pressing member presses the elastic member of the bracket to cause the bracket to turn to move the ejection guide member away from the nip portion. Then, the tips of the plurality of separation pawl members are separated from the surface of the one of the pair of rotating members by turning the pawl stopper in a direction. As a result, the pawl stopper disengages from the engaging portion of the fixing mechanism in response to a different motion of the lever in a sheet jam recovery process.

In the novel image forming apparatus, a slant portion of the pawl stopper is kept in contact with the engaging portion of the fixing mechanism when the pressing member presses the elastic member of the bracket and the bracket turns to move the ejection guide member away from the nip portion. Then, the tips of the plurality of separation pawl members are separated from the surface of the one of the pair of rotation members by turning the pawl stopper in the direction to disengage from the engaging portion of the fixing mechanism. This operation is performed in response to a different motion of the lever in a sheet jam recovery process.

In the novel image forming apparatus, each of the plurality of separation pawl members includes a separation pawl and a separation pawl holder. The separation pawl holder further includes a pressing member for pressing the separation pawl in the direction in which the tips of the plurality of separation pawl members are pressed to the surface of the one of the pair of rotating members. In addition, the separation pawl member is configured to hold the separation pawl for rotation relative to the rotating shaft. In addition, the bracket includes a plurality of mounting portions. The mounting portion is further configured to mount the plurality of separation pawl members with the plurality of respective separation pawl holders pivotable about the plurality of respective mounting portions. Each of the plurality of mounting portions includes a stopper. The stopper is configured to regulate a movement of the separation pawl in the direction in which the tips of the plurality of separation pawl members are pressed to the surface of the one of the pair of rotating members.

In the novel image forming apparatus, the rotating shaft includes a protrusion. The protrusion is configured to engage with the stopper when the separation pawl is lifted up due to a jam of the recording sheet. Accordingly, the tips of the plurality of separation pawl member are separated from the one of the pair of rotating members by at least a predetermined distance when a recording sheet jam occurs.

In the novel image forming apparatus, each of the plurality of separation pawl members further includes a sub-holder and a roller. The sub-holder is configured to share the rotating shaft with the separation pawl holder. The roller is held by the sub-holder at a portion close to the separation pawl. In addition, the roller is configured to rotate by friction generated by contact with the recording sheet. Accordingly, the roller guides the recording sheet for ejection after completion of the fixing process.

In the novel image forming apparatus, the ejection guide member further includes an idle roller. The idle roller is configured so that the idle roller is kept in contact with the surface of the one of the pair of rotating members during the fixing process. Moreover, the idle roller allows the ejection guide member to swing about the center axis when the idle roller is kept in contact with the surface of the one of the pair of rotating members during a process of disengagement of the ejection guide member.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings; wherein.

DETAILED DESCRIPTION OF THE PREFERRED EMBODIMENTS

Figure 1:
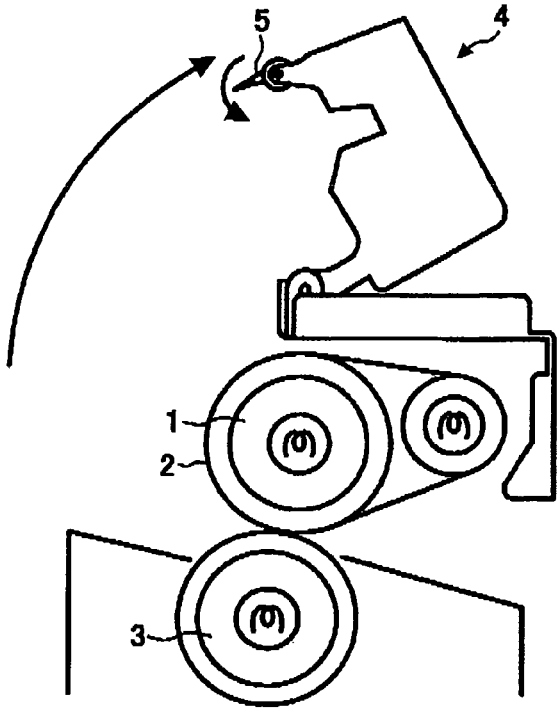
FIG. 1 RELATED ART
FIG. 1 is a schematic sectional view illustrating a structure of a related art fixing device in which a paper ejection guide is released from the fixing device.

This patent specification is based on Japanese patent application No. JPAP2004-175551 filed on Jun. 14, 2004 in the Japan Patent Office, the entire contents of which are incorporated reference herein.

In describing preferred embodiments illustrated in the drawings, specific terminology is employed for the sake of clarity. However, this patent specification is not intended to be limited to the specific terminology so selected and it is to be understood that each specific element includes all technical equivalents that operate in a similar manner.

In addition, various modifications and improvements are possible without departing from the spirits and scope of the invention.

A configuration of each part without a particular description being given is the same throughout an embodiment as illustrated in FIGS. 3 through 12, and the same reference numerals are attached to the same part so that a redundant description will be avoided for simplicity.

Referring now to the drawings, wherein like reference numerals designated identical or corresponding parts throughout the several views, a fixing device provided in the image forming apparatus according to an embodiment of the present invention will be explained.

Figure 2:
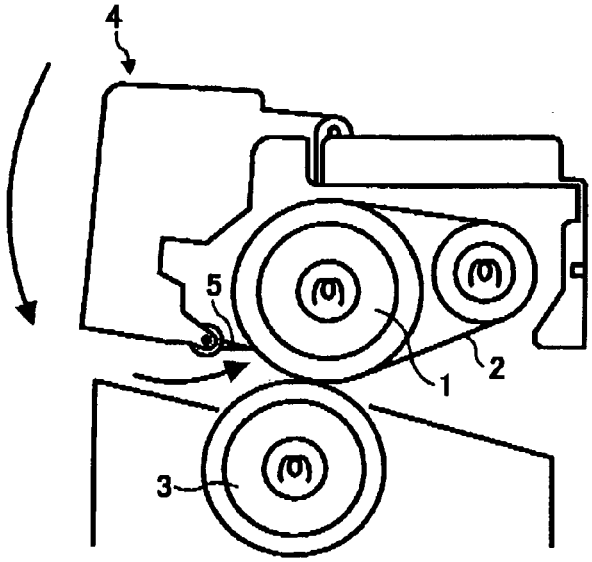
FIG. 2 RELATED ART
FIG. 2 is a schematic sectional view illustrating a structure of a related art fixing device in which the paper ejection guide is returned to a locked position.

Referring to FIGS. 1 and 2, a schematic structure of a related art fixing device is illustrated. The fixing device includes a fixing roller 1, a fixing belt 2, a heating roller 3, and a paper ejection guide 4. The paper ejection guide 4 further includes a plurality of separation pawls 5. It should be noted that the fixing device in the related art does not include a mechanism for separating the plurality of separation pawls 5, which will be described later in detail. Accordingly, the operation for separating the separation pawls 5 will not occur.

In FIG. 1, when releasing to open the paper ejection guide 4, such as, when dealing with a jammed sheet, the paper ejection guide 4 is released from the fixing device as illustrated by a large arrow. At this time, the separation pawls 5 rotate inward as illustrated by a small arrow, due to the absence of the fixing belt 2 as a counterpart to abut the separation pawls 5.

In FIG. 2, the paper ejection guide 4 is returned to a predetermined locked condition after dealing with the jammed sheet, as illustrated by a large arrow. However, since the separation pawls 5 remain in a fully inwardly rotated position, then the tips of separation pawls 5 may bump into the fixing belt 2, as illustrated by a small arrow, which will damage the fixing belt.

A fixing device provided in an image forming apparatus according to an embodiment of the present invention will be explained below with reference to FIG. 3.

A full color type copier is used as an example for explaining the present invention.

Figure 3:
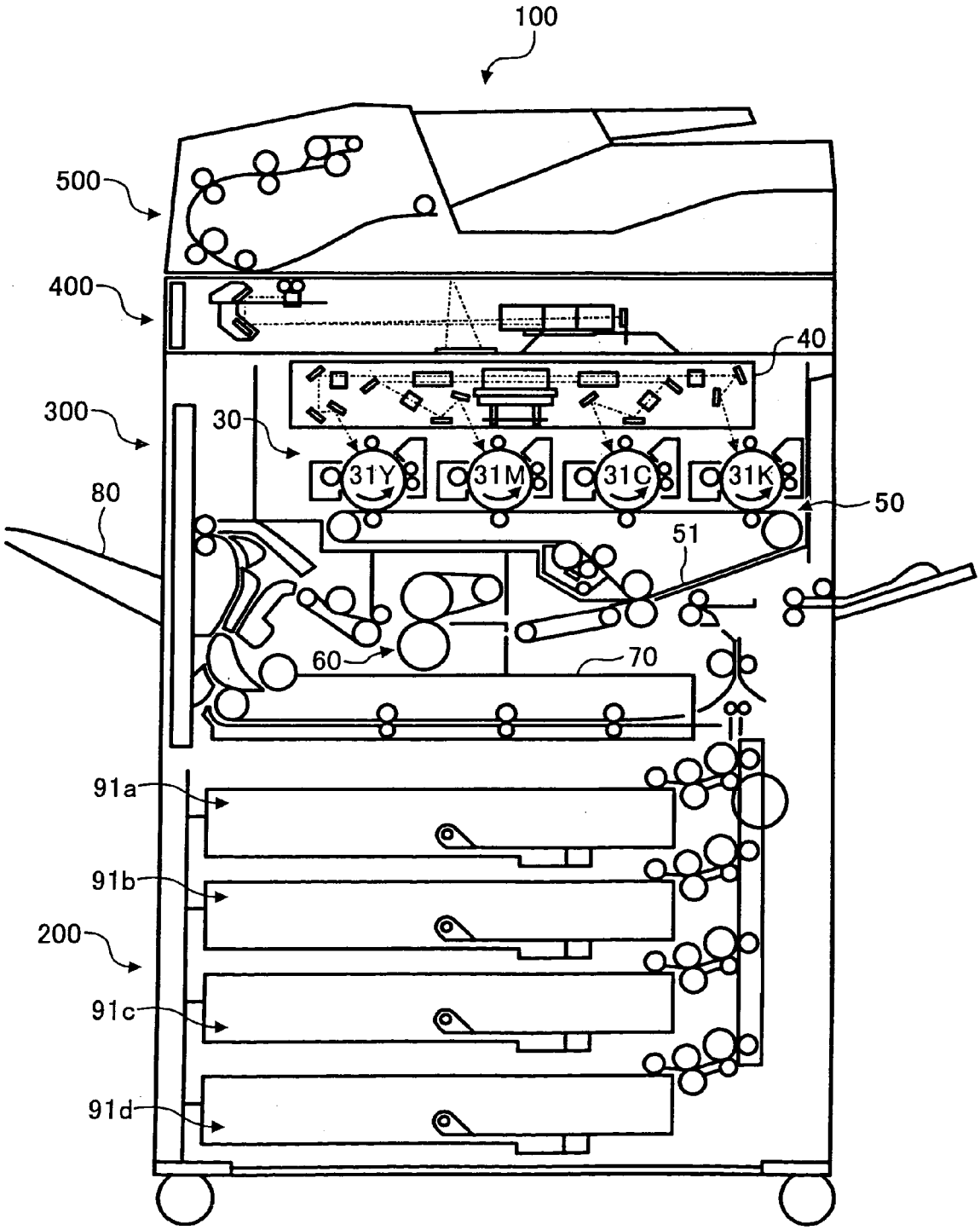
FIG. 3 is an explanatory diagram schematically illustrating an exemplary structure of an image forming apparatus according to an embodiment of the present invention.

Referring now to FIG. 3, the image forming apparatus 100 includes a paper feed part 200, an image forming part 300, a document reading part 400, and a document conveyance part 500. The image forming apparatus 100 further includes a double-face reversal mechanism 70, a paper ejection tray 80, or the like. Note that reference numerals 91*a* through 91*d* indicate paper feed cassettes, respectively.

The image forming part 300 includes an image forming unit 30, an exposure mechanism 40, a transfer mechanism 50, and a fixing mechanism, such as, a fixing device 60. The image forming unit 30 includes four image forming mechanisms arranged in parallel for forming four colors of toner images such as Black (K), Cyan (C), Magenta (M), and Yellow (Y). The image forming unit 30 further includes photoconductors 31K, 31C, 31M, and 31Y, at central portions of the respective image forming units. In addition, each of the image forming units 30 includes a charging device, a developing device, and a cleaning device arranged around the photoconductor.

The exposure mechanism 40 converts data read by the document reading part 400 or image signals transmitted from an external apparatus such as a personal computer (not illustrated) into optical signals such as laser light to form electrostatic latent images on the photoconductors 31K, 31C, 31M, and 31Y.

The transfer mechanism 50 is configured to include an intermediate transfer belt 51 for sequentially superposing the toner images formed on the respective photoconductors 31K, 31C, 31M, and 31Y to hold the toner images thereon, so that a color toner image formed on the intermediate transfer belt 51 is transferred on a recording sheet. Otherwise, another structure may be employed, for example, the toner images formed on the respective photoconductors 31K, 31C, 31M, and 31Y are directly transferred onto the recording sheet conveyed by a transfer conveyance belt.

The fixing device 60 is configured to include a belt laid across rollers, which contain heaters therein, in a tensioned condition, and a pressure roller. The fixing device 60 further includes a nip part having both the belt and the pressure roller applying heat and pressure onto the toner on the recording sheet to fix the toner image. Otherwise, the fixing device 60 may use a pair of rollers or a pair of belts.

Figure 4:
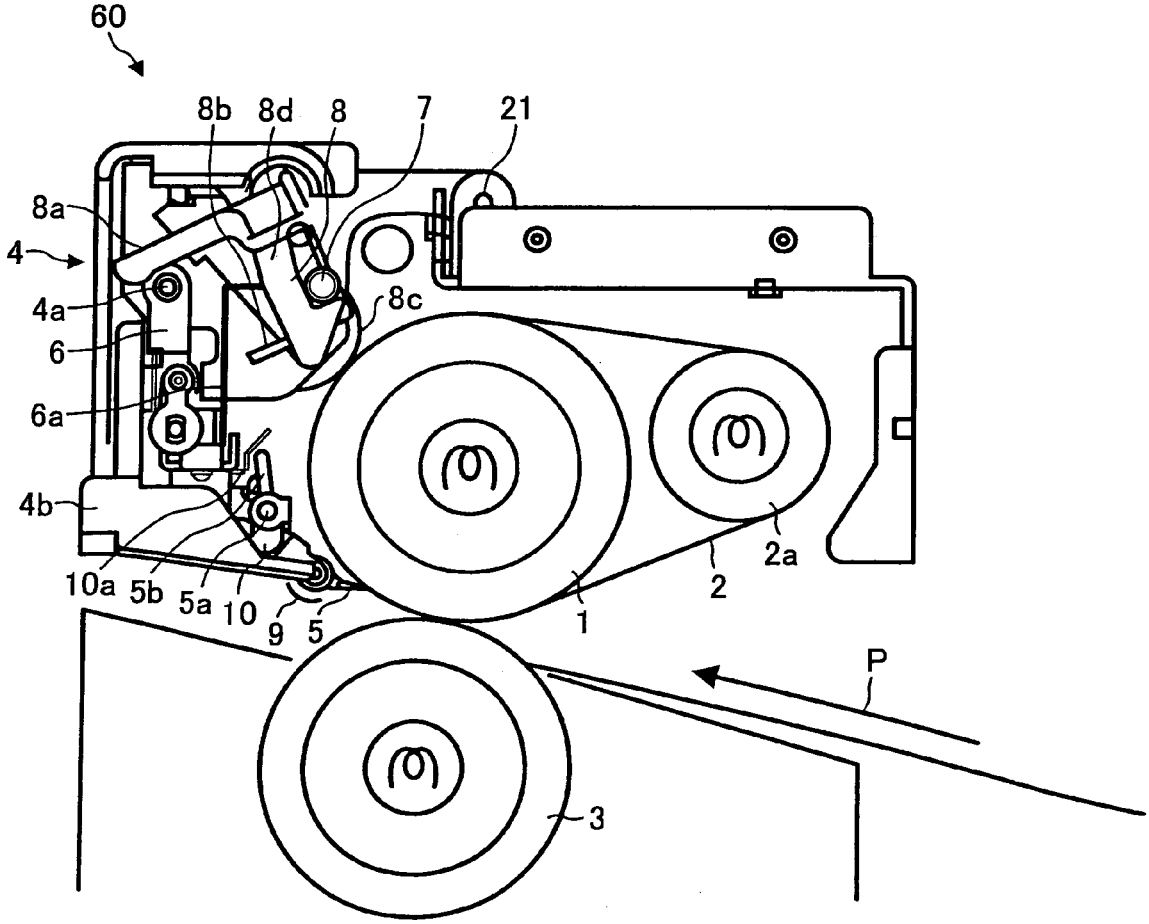
FIG. 4 is a sectional view illustrating a structure of a fixing device provided in the image forming apparatus of FIG. 3, in which a paper ejection guide of the fixing device is at operational position.

As illustrated in FIG. 4, the fixing device 60 includes two parts; one is the nip part and the other is a paper ejection guide 4. In FIG. 4, the paper ejection guide 4 is locked with respect to a fixing belt 2. In other words, FIG. 4 illustrates a condition in which tips of a plurality of separation pawls 5 are in contact with a surface of the fixing belt 2 in order to perform a fixing process.

In the fixing device 60 according to FIG. 4, the nip part is configured in such a manner that the fixing device 60 includes a fixing roller 1 serving as a fixing member, an auxiliary roller 2*a* arranged inside the fixing belt 2, and a heat roller 3 serving as a pressure member. The fixing roller 1 and the heat roller 3 are arranged opposite to each other relative to the fixing belt 2 so that the fixing belt 2 can be pressurized by and between the fixing roller 1 and the pressure roller 3.

The respective rollers 1, 2*a* and 3 contain halogen heaters as heat sources therein and convey a sheet as a recording medium holding an unfixed toner image thereon, from a right side in FIG. 4. The nip part supports the sheet from both sides thereof to heat the sheet, so that the toner image can be fixed.

Hereinafter, the paper ejection guide 4 that is another part of the fixing device 60 will be explained.

The paper ejection guide 4 in the fixing device 60 is configured to include a pair of fulcrum holes 4*a*, a paper ejection guide main body 4*b*, a plurality of separation pawls 5, a plurality of rotation shafts 5*a*, a plurality of projected bump pieces 5*b*, a bracket 6, a plate spring 6*a*, a pawl stopper 8, the plurality of separation pawl units 9, an idle roller 8*c*, and a spindle 21. The paper ejection guide 4 is a pivot body. In addition, the paper ejection guide 4 is formed with respect to a main body of the fixing device 60 in such a manner that the paper ejection guide 4 pivots freely around the spindle 21. It should be noted that the plate spring 6*a* is an elastic member and the idle roller 8*c* is an abutting member. In addition, the pair of fulcrum holes 4*a* is used to receive a shaft (not illustrated) for supporting the paper ejection guide 4, and a center axis 4*c* (illustrated in FIG. 5) extends through each center of the pair of fulcrum holes 4*a* in FIG. 4. The center axis 4*c* will be explained below with reference to FIG. 5.

The bracket 6 includes a plurality of mounting portions 10 and is configured to pivot freely around the center of the pair of fulcrum holes 4*a* of the paper ejection guide 4. In other words, the paper ejection guide 4 is provided so that the paper ejection guide 4 is capable of being freely released and locked with respect to the nip part which includes the fixing belt 2 and the heat roller 3. This mechanism can be used to remove the recording sheet jammed in the fixing device 60. Thus, the spindle 21 is provided in the main body of the fixing device 60.

The spindle 21 supports the paper ejection guide 4, which serves as the pivot body, with the plurality of separation pawls 5 to allow the paper ejection guide 4 to pivot freely around the spindle 21.

The separation pawls 5 will be described later in detail. The paper ejection guide main body 4*b* is used for guiding the sheet toward an ejection roller (not illustrated) after the fixing of the toner image.

Hereinafter, the paper ejection guide 4 will be explained in more detail.

The pawl stopper 8 includes a stopper main body 8*d*, a lever 8*a*, and a pressing member 8*b*. The pawl stopper 8 is provided in such a manner that the pawl stopper 8 is capable of pivoting with respect to the paper ejection guide 4.

The receiving part 7 is provided at an appropriate position in the fixing device 60 in a manner that a position of the receiving part 7 is fixed. The receiver 7 is used for receiving the stopper main body 8*d* that is formed on one end of the pawl stopper 8. The pawl stopper 8 is capable of engaging and disengaging with the receiving part or engaging portion 7 by using the stopper main body or slant portion 8*d* in response to a pivoting motion of the pawl stopper 8.

The pawl stopper 8 engages with the receiving part 7, so that the paper ejection guide 4 can be locked with respect to the nip part. The lever 8*a* is integrally provided at the pawl stopper 8. The lever 8*a* is used to release the locked condition of the paper ejection guide 4. The pressing member 8*b* is integrally provided on the pawl stopper 8. Moreover, the plate spring or elastic member 6*a* is provided on the bracket 6.

The pressing member 8*b* is configured to press against the plate spring 6*a* to pivot the bracket 6 when the pawl stopper 8 pivots in a direction to release the paper ejection guide 4, so that the tips of the separation pawls 5 attached to the bracket 6 are separated from surfaces of the fixing belt 2 and the heat roller 3.

Furthermore, the idle roller 8*c* is configured to be provided in the paper ejection guide 4, so that the paper ejection guide 4 pivots around the center of the pair of fulcrum holes 4*a* in a condition in which the idle roller 8*c* is in contact with the surface of the fixing belt 2, while on the other hand, in the fixing process, the idle roller 8*c* maintains a condition in which the idle roller 8*c* is in contact with the surface of the fixing belt 2.

In the fixing process, the stopper main body 8*d* engages with the receiving part 7 by operation of the lever 8*a* to hold the paper ejection guide 4 in a predetermined position, so that the tips of the separation pawls 5 are in contact with the surface of the fixing belt 2. It should be noted that, the fixing belt 2 is one of a pair of rotation bodies constituting the nip part. As a result, a condition illustrated in FIG. 4 is achieved. In other words, the condition in which the paper ejection guide 4 locks the nip part is achieved.

The separation pawl units 9 are attached to the bracket 6. Moreover, the separation pawl units 9 have a mechanism for attaching the separation pawls 5.

The mounting portions 10 are provided on the bracket 6. In addition, the mounting portions 10 have a mechanism for mounting the separation pawl units 9 thereon.

The stoppers 10*a* are provided respectively on the mounting portions 10 and include a mechanism to bump against the projected bump pieces 5*b* projected from a surface of the rotation shaft 5*a* to separate the tips of the separation pawls 5 from the surface of the fixing roller 2. The rotation shafts are provided on the separation pawl units 9. The rotation shafts 5*a* support the respective separation pawls 5 and include a mechanism around which the separation pawls 5 pivot. The projected bump piece 5*b* will be described in explaining an operation for recovering from the jam of the recording sheet caused in the fixing device 60. The projected bump piece 5*b* is used for separating the tip of the separation pawl 5 from the surface of the fixing belt 2. The idle roller 8*c* is provided in the paper ejection guide 4. In addition, the idle roller includes a mechanism to abut the surface of the fixing belt 2.

Figure 5:
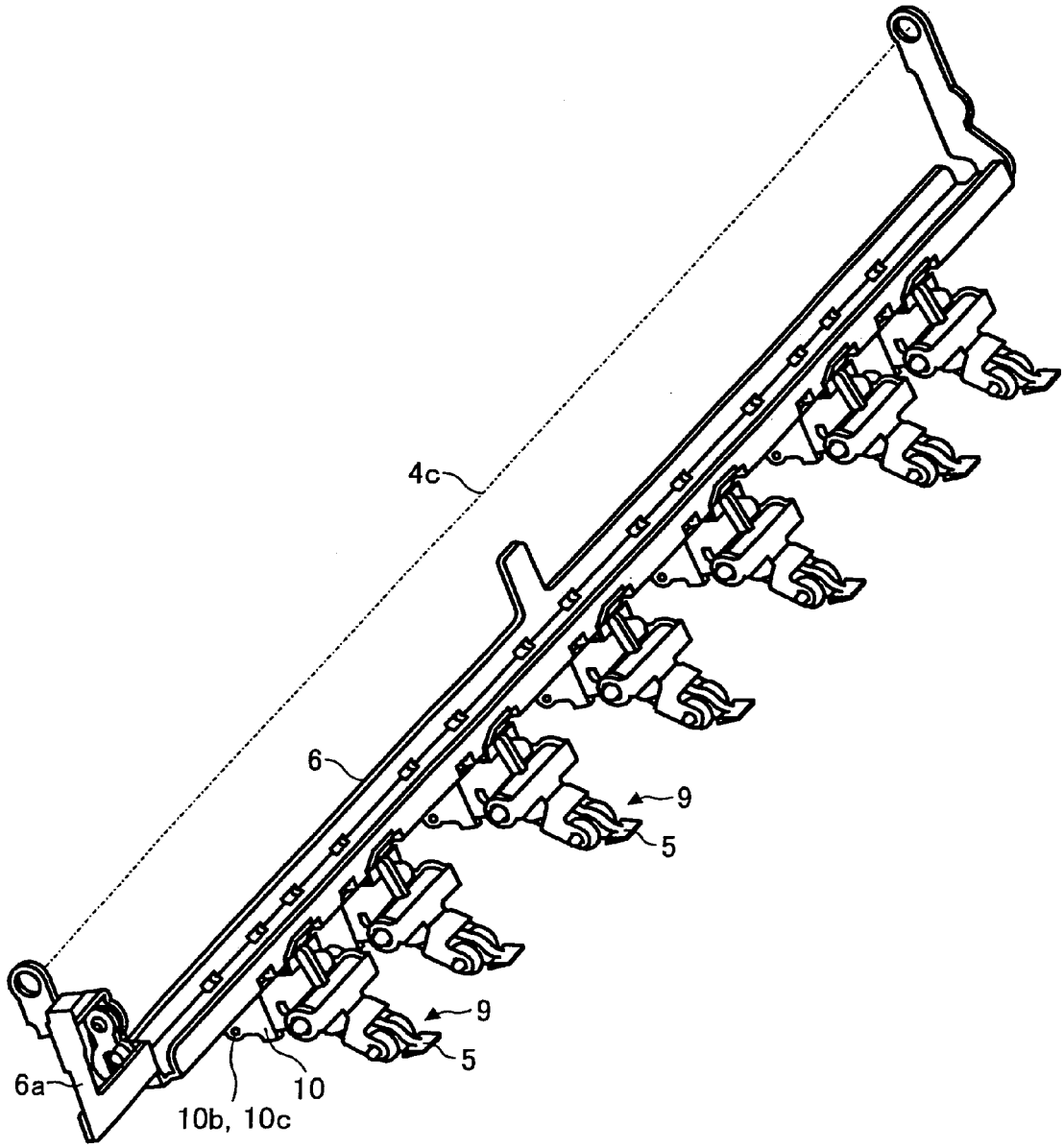
FIG. 5 is a perspective view illustrating a structure of separation pawl units arranged on a bracket provided in the fixing device according to FIG. 4.

Referring now to FIG. 5, an example structure of the bracket 6 is explained with respect to the plurality of separation pawls 5. Each of the separation pawls 5 is arranged on the bracket 6. The bracket 6 is attached to the paper ejection guide 4. The bracket 6 is configured to include a plurality of pair of opposing pieces 10*b* to form the mounting portions 10 on which the separation pawl units 9 are mounted. Each pair of opposing pieces 10*b* includes protrusions 10*c* on a pair of opposing surfaces of the opposing pieces 10*b*.

The separation pawl units 9 provided with the separation pawls 5 are attached, in a pivotable manner, to the mounting portions 10 of the bracket 6.

As described above, the plurality of separation pawls 5 are attached to the bracket 6. The bracket 6 is attached to the paper ejection guide 4 so that the bracket 6 is capable of pivoting around the center axis 4*c* of the shaft supported by the pair of fulcrum holes 4*a*. In other words, the bracket 6 is capable of pivoting around the center of the pair of fulcrum holes 4*a*. On the other hand, the bracket 6 is biased so that the tips of the separation pawls 5 are in contact with the surface of the fixing belt 2 when the paper ejection guide 4 is settled at the locking position.

As described above, the fixing device 60 allows for a reduction in the number of parts and number of assembly processes because the plurality of separation pawls 5 are provided in a single unit of the paper ejection guide 4.

Figure 6:
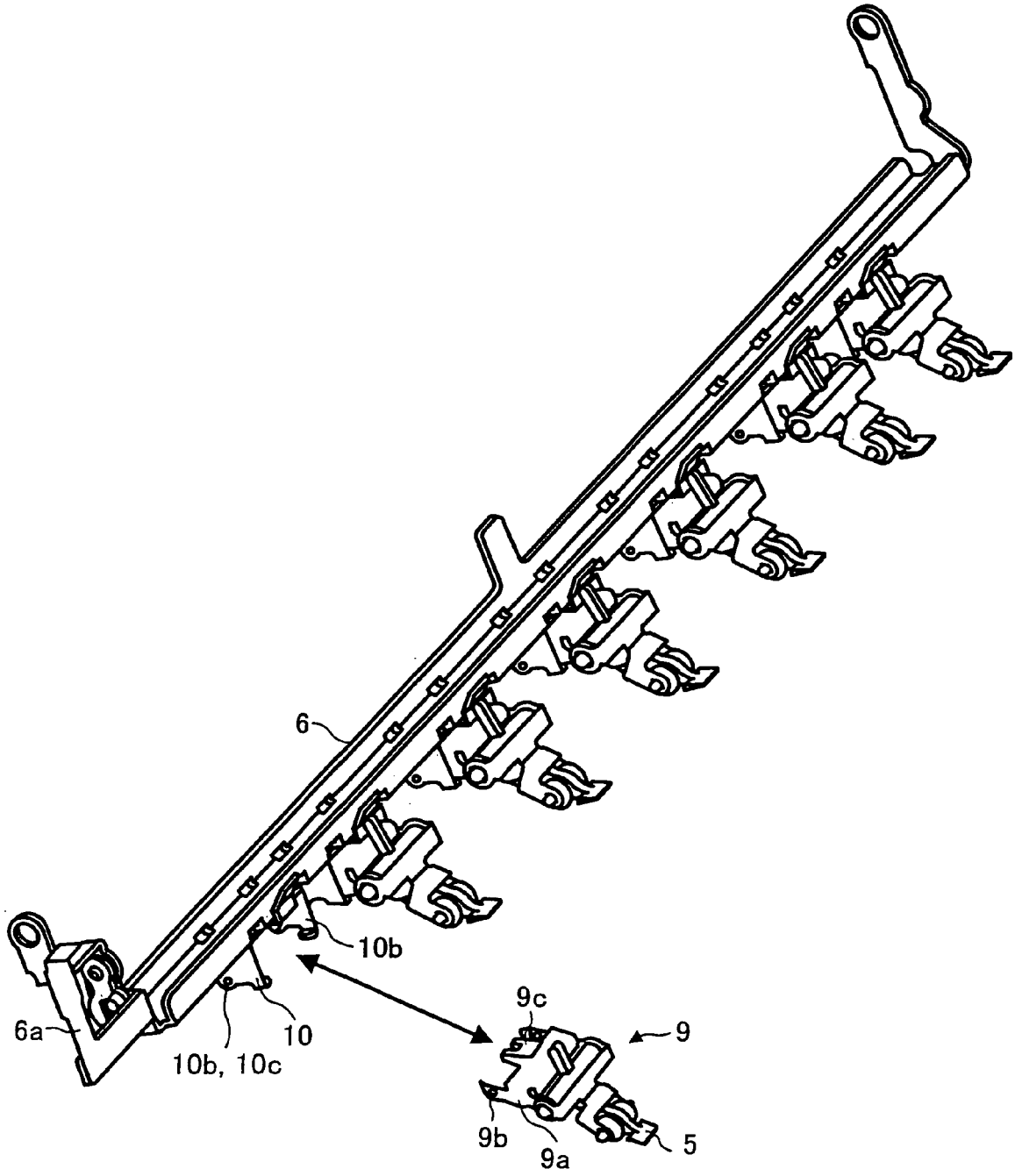
FIG. 6 is a perspective view illustrating how the separation pawl units are attached to the bracket in the fixing device according to FIG. 4.

Referring now to FIG. 6, an exemplary method of installing the separation pawl unit 9 to the bracket 6 is illustrated. As illustrated in FIG. 6, each of the separation pawls unit 9 includes a separation pawl holder 9*a*, which includes a pair of engaging holes 9*b* and a plate spring 9*c*. The pair of engaging holes 9*b* is formed on the separation pawl holders 9*a*. The pair of engaging holes 9*b* is used for attaching the separation pawl units 9 to the respective mounting portions 10. On the other hand, the plate springs 9*c* are also formed on the separation pawl holders 9*a*. The plate springs 9*c* are used to bias the separation pawls 5 toward the surface of the fixing belt 2, so that the tips of the separation pawls 5 are in contact with the surface of the fixing belt 2.

When inserting the separation pawl units 9 into the mounting portion 10 provided on the bracket 6, the separation pawl 5 is held at the predetermined position with the elasticity of the plate spring 9*c* forming a part of the separation pawl holder 9*a*. In other words, the pair of engaging holes 9*b* is used as a center around which the separation pawl units 9 pivot to attach the separation pawl unit 9 to the bracket 6 to the mounting portion 10. On the other hand, a pair of opposing pieces 10*b*, which constitute the mounting portion 10, is provided with the protrusions 10*c* on respective opposing inner surfaces thereof. The protrusions 10*c*, thus formed, oppose each other. Accordingly, when inserting the separation pawl unit 9 into the mounting portion 10, inserting the protrusions 10*c* into the pair of engaging holes 9*b* together provide for a bearing structure similar to a pivot bearing.

According to the structure illustrated in FIG. 6, attaching and detaching operations of each separation pawl unit 9 to each mounting portion 10 can be performed without using fastenings such as screws. Therefore, quick maintenance of the separation pawl units 9 can be achieved with ease. With this structure, when dealing with the jam caused by a wound sheet, a suitable treatment can be achieved.

Figure 7:
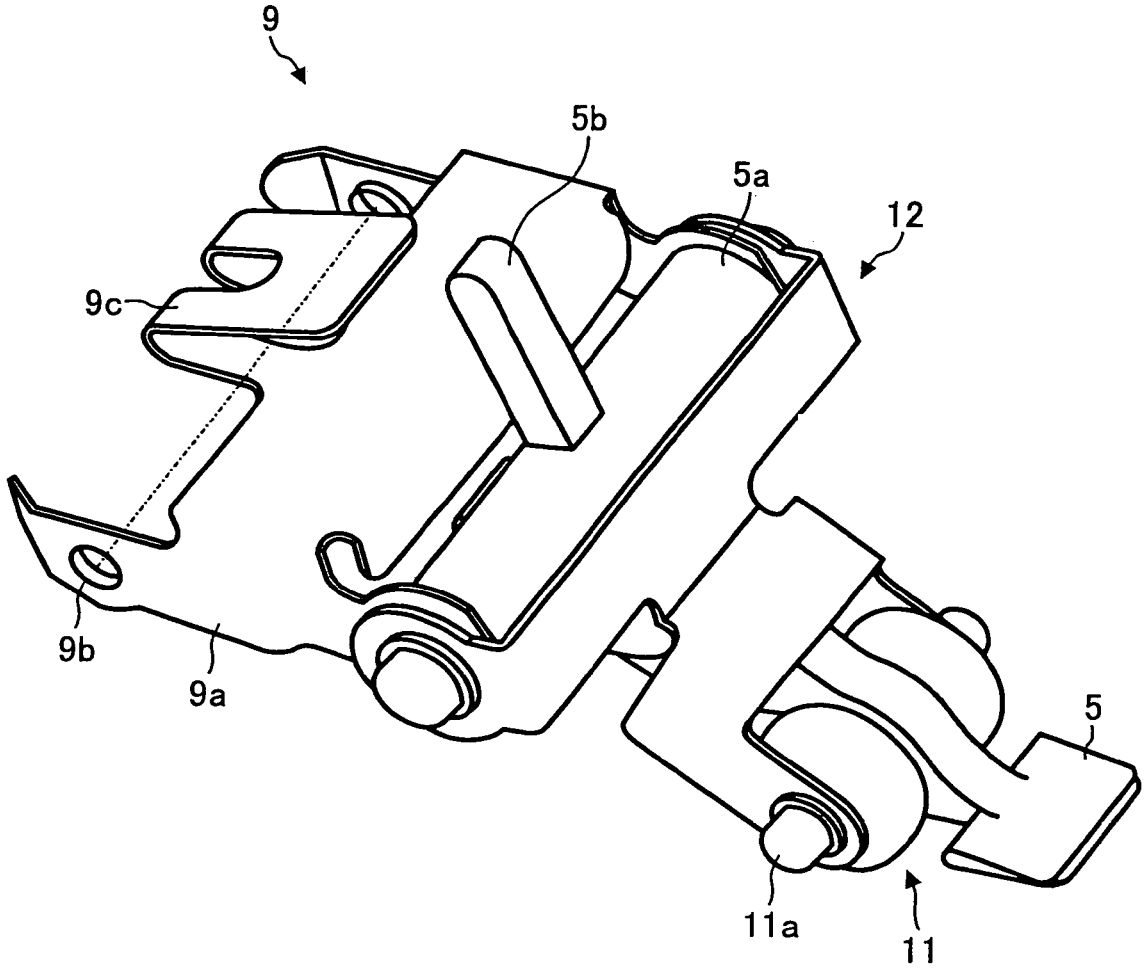
FIG. 7 is a perspective view illustrating a detailed structure of the plurality of separation pawl units in FIG. 6.

Referring now to FIG. 7, an exemplary structure of the separation pawl unit 9 is explained. As illustrated in FIG. 7, each one of the single separation pawl units 9 includes the separation pawl 5, the rotation shaft 5*a*, the projected bump piece 5*b*, the separation pawl holder 9*a*, the pair of engaging holes 9*b*, the plate spring 9*c*, a pair of rollers 11, a rotation shaft 11*a*, and a holder 12.

In the separation pawl unit 9, the pair of rollers 11 capable of freely rotating is provided at a position proximate to the separation pawl 5. That is, the rollers 11 are provided on a rear side of a traveling direction of the recording sheet. On the other hand, both end portions of the rotation shaft 5*a* are held by the separation pawl holder 9*a* and the holder or sub-holder 12. The holder 12 is used for holding the rotation shaft 5*a* in conjunction with the separation pawl holder 9*a*. Accordingly, the pair of rollers 11 is rotatable while contacting the recording sheet, which is traveling.

In the fixing process, the traveling recording sheet after completion of the toner fixing process is guided by means of the pair of rollers 11. The roller holder 12 holds the pair of rollers 11 by holding both ends of the rotation shaft 11*a*. That is, the holder 12 holds the rotation shaft 5*a* for the separation pawl 5 together with the separation pawl holder 9*a*, while supporting the pair of rollers 11 in a rotatable manner.

Figure 8:
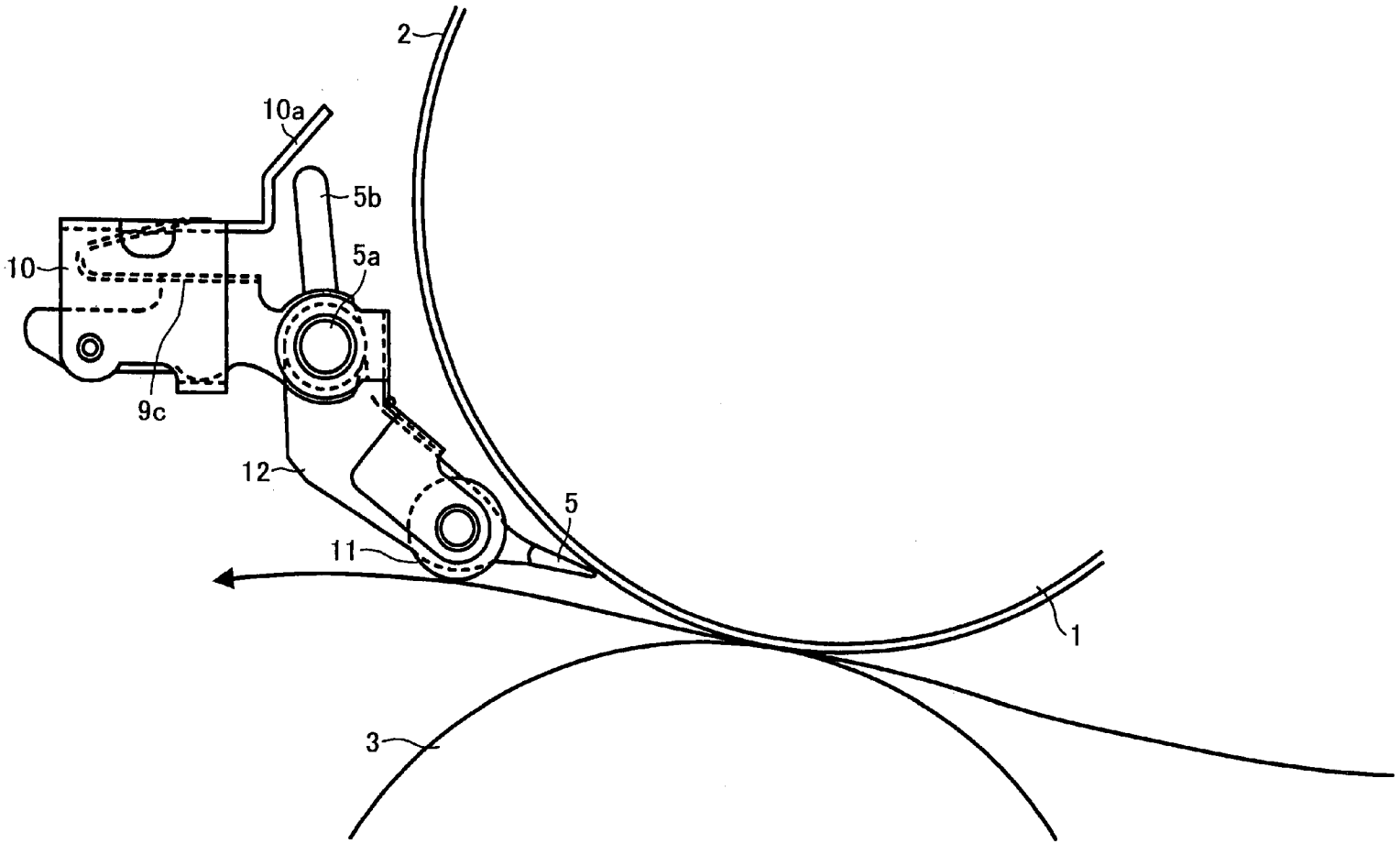
FIG. 8 is a sectional view illustrating a motion of driven rollers provided to the separation pawl unit according to FIG. 4.

Referring now to FIG. 8, an operation of the separation pawl 5 when the recording sheet is transported is explained. As shown in FIG. 8, a function of the pair of rollers 11 is to guide and convey the recording sheet, on a surface, which has the fixed toner image, and to prevent the recording sheet separated from the surface of the fixing belt 2 from slidably moving in conjunction with the separation pawl 5. In this case, since the pair of rollers 11 is driven by the contact with the recording sheet to rotate, no substantial scraping friction is caused based on a relative velocity difference between the pair of rollers 11 and the recording sheet. Thus, irregularity in fixed toner image on the recording sheet can be prevented from occurring.

Figure 9:
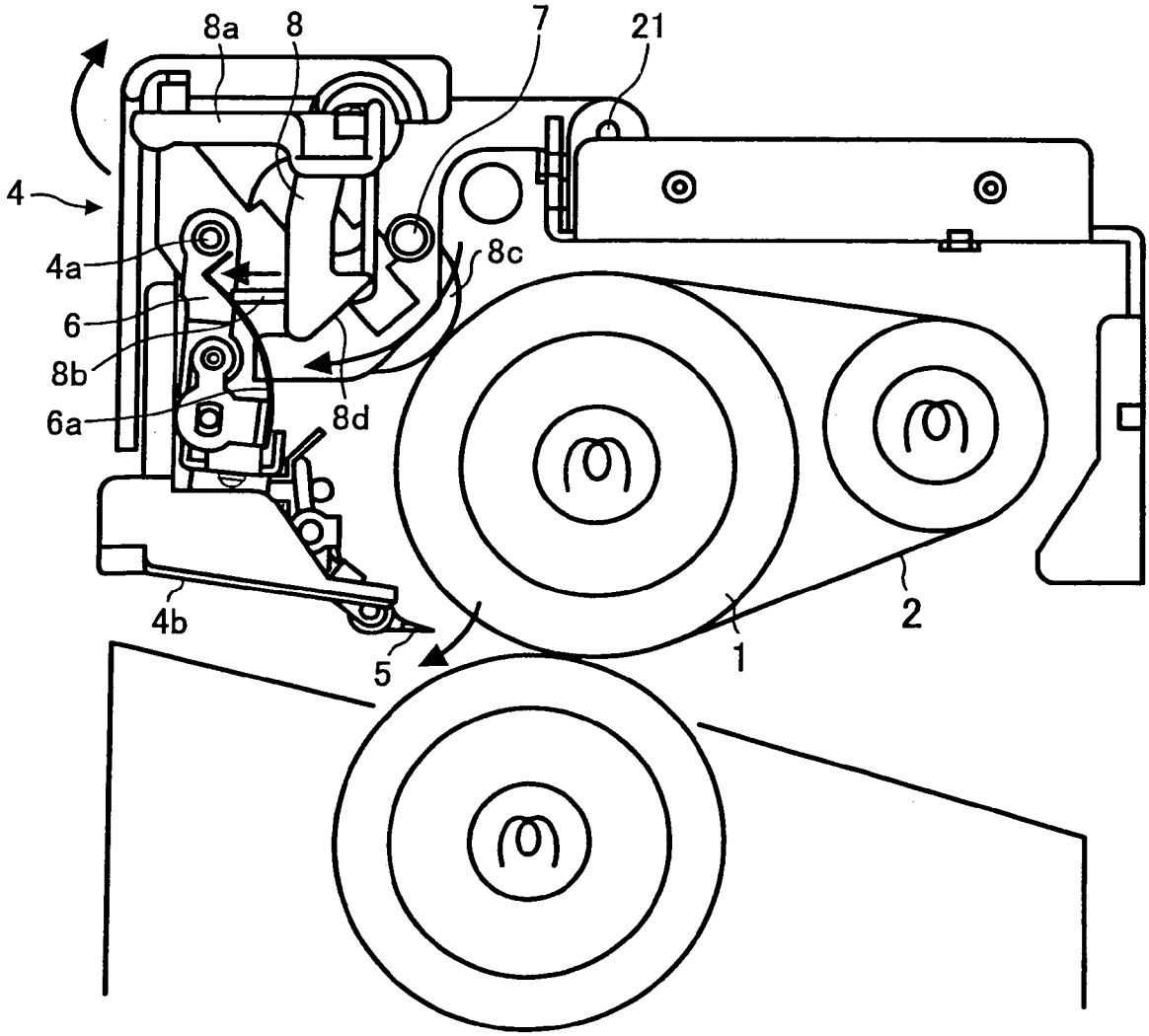
FIG. 9 is a sectional view illustrating a condition in which the paper ejection guide is released from the operational position in the fixing device according to FIG. 4.

Referring now to FIG. 9, in the fixing device 60 as described above, the bracket 6 is provided with the plurality of separation pawls 5, and the bracket 6 is held by the paper ejection guide 4 while freely pivots around the center of the pair of fulcrum holes 4*a*. The bracket 6 is typically biased at a predetermined position. In FIG. 4, the paper ejection guide 4 maintains the locked condition by causing the pawl stopper 8 to engage with the receiving part 7 provided in the fixing device 60 in a fixed manner.

The tips of the separation pawls 5 are slidably in contact with the fixing belt 2, in a normal condition as illustrated in FIG. 4, to separate the recording sheet having the toner image thereon, in the fixing device 60.

Next, operations performed by using the fixing device 60 when dealing with a jammed recording sheet will be explained with reference to FIGS. 9 through 11.

When the recording sheet is jammed, at first, as illustrated in FIG. 9, the pawl stopper 8 is disengaged from the receiving part 7 of the main body of the fixing device 60 by pulling up the lever 8*a*. The lever 8*a* is integrally formed with the pawl stopper 8. The pressing member 8*b* integrally formed with the stopper pawl 8 presses the plate spring 6*a* as the elastic member integrally formed with the bracket 6 having the plurality of separation pawls 5. This mechanism causes the bracket 6 to pivot around the center of the fulcrum holes 4*a* in a direction in which the separation pawls 5 are separated from the fixing belt 2, so that the separation pawls 5 separate therefrom.

Figure 10:
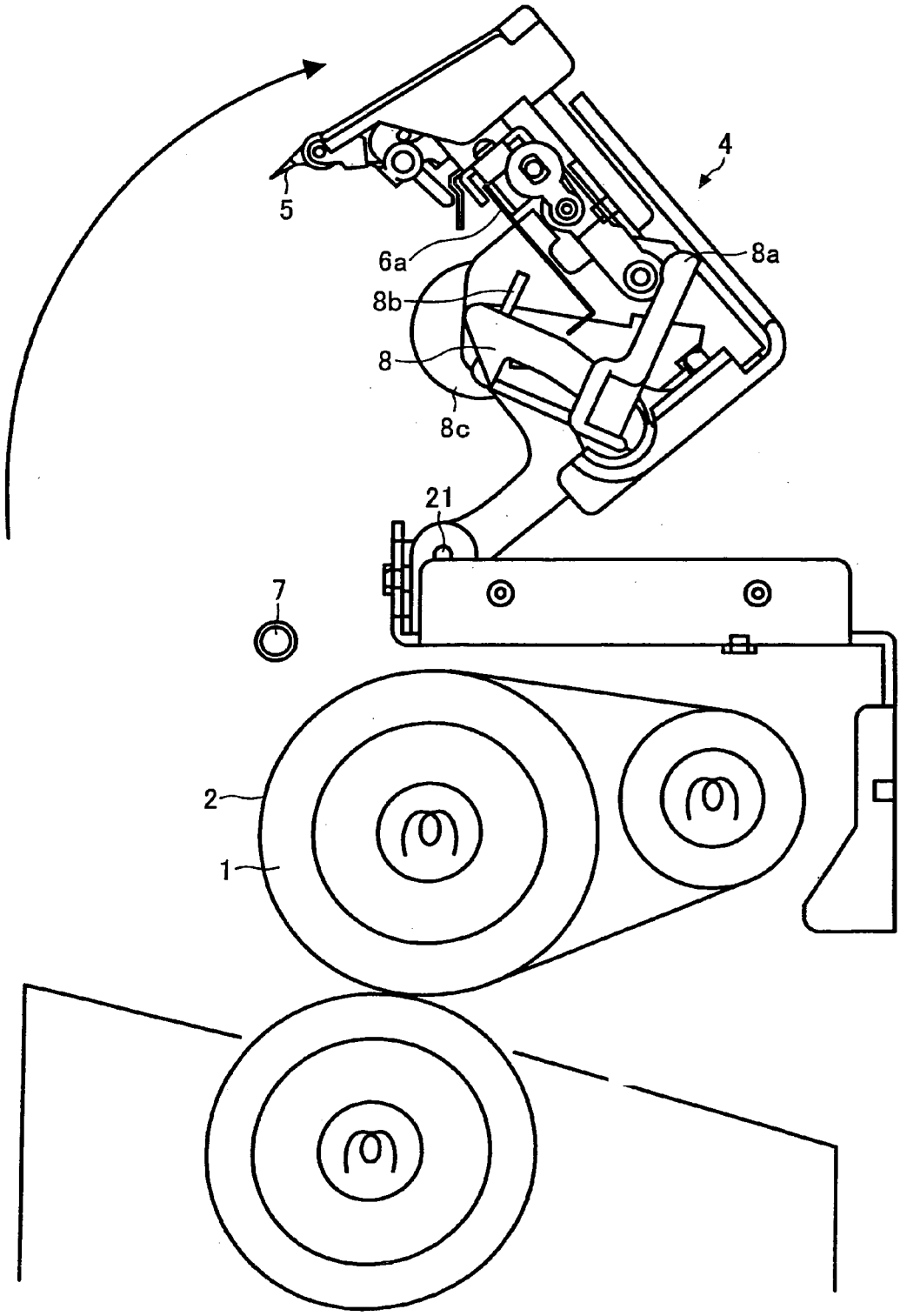
FIG. 10 is a sectional view illustrating a condition in which the paper ejection guide is at an upward position following the operational position according to FIG. 9.

Referring now to FIG. 10, a condition is illustrated in which the jammed recording sheet is released by opening the paper ejection guide 4 with respect to the fixing belt 2. That is to say, the jammed recording sheet is dealt with by releasing the nip part of the fixing device 60.

As illustrated in FIG. 10, the paper ejection guide 4 is released, in this condition, from the fixing belt 2 together with the plurality of separation pawls 5. The jammed recording sheet is capable of being removed under the condition in which the paper ejection guide 4 is released. However, as illustrated in FIG. 10, when the recording sheet is jammed, the paper ejection guide 4 provided with the plurality of separation pawls 5 is released to deal with the jammed recording sheet. In this case, since the plurality of separation pawls 5 and the paper ejection guide 4 are released to widely open, a user can easily remove the jammed recording sheet.

Figure 11:
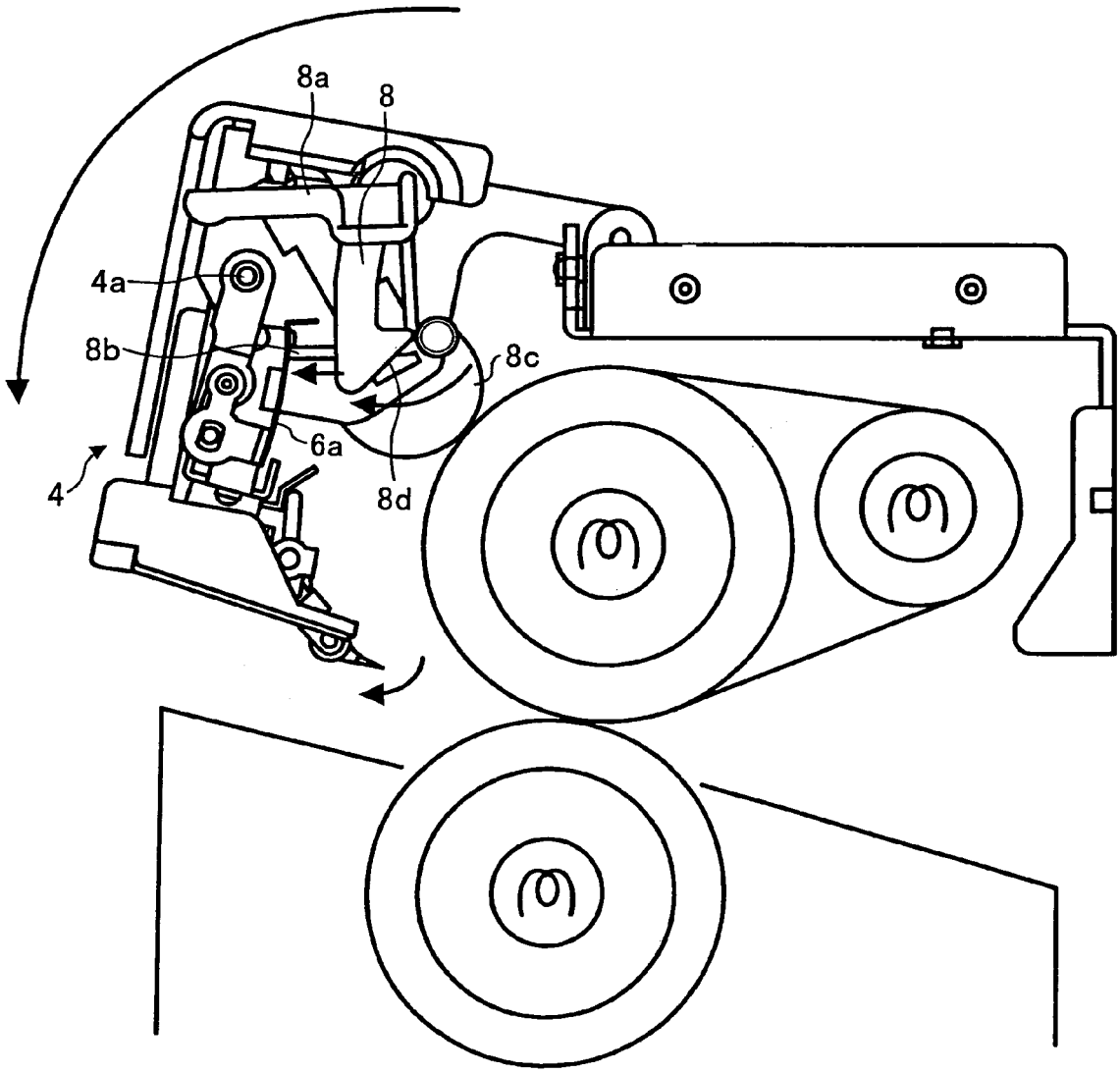
FIG. 11 is a sectional view illustrating a condition in which the paper ejection guide is at a downward position following the upward position according to FIG. 10.

Referring now to FIG. 11, a condition as follows is illustrated. Namely, the paper ejection guide 4 is returned, again, to a locked condition after completion of the removal of the jammed recording sheet is illustrated.

The jammed recording sheet is dealt with in this released condition. When the jammed recording sheet is dealt with, the paper ejection guide 4 is returned to the predetermined locked condition, as illustrated in FIG. 11. When returning the paper ejection guide 4 to the locked condition, the pawl stopper 8 pivots in a condition in which a sloped portion 8*d* of the pawl stopper 8 is in contact with the receiving part 7 of the main body of the main body of the fixing device 60. On the other hand, the idle roller 8*c* as the abutting member is in contact with an upper side portion of the fixing belt 2. Then, the pressing member 8*b* formed on the pawl stopper 8, in an integrated fashion, moves simultaneously to press the plate spring 6*a* formed with the bracket 6 in an integrated fashion.

In the above mechanism, when returning the paper ejection guide 4 to the locked condition, separation of the bracket 6 provided with the plurality of separation pawls 5 from the fixing belt 2 is automatically performed. The paper ejection guide 4 can be returned to the condition illustrated in FIG. 4 without bumping of the plurality of separation pawls 5 against a surface of an abutting counterpart, such as the surface of fixing belt, by further pulling up the lever 8*a*. As a result, the fixing process can be resumed without damaging the surface of the counterpart, such as the surface of the fixing belt 2.

As described above, in the fixing device 60, when releasing and locking the paper ejection guide 4 in dealing with the jammed recording sheet, since the paper ejection guide 4 is configured to be forcibly separated from the fixing belt 2, assembly of a device with a reduced number of parts and processes can be achieved. Accordingly, a reduction in assembly costs can be achieved.

In addition, in the fixing device 60 described above, the jammed recording sheet can be suitably removed, with ease, from the fixing device 60 without causing the disadvantages described above. In addition, since the structure thereof described in FIG. 4 is quite simple, a fixing device 60 with reduced costs is provided.

Furthermore, in the fixing device 60 described above, when the plurality of separation pawls 5 are in contact with the abutting counterpart, such as the surface of the fixing belt 2 and the fixing roller 1, to prepare the fixing device 60 for a resumption of the fixing process, the jammed recording sheet can be suitably removed, with ease, from the fixing device 60 without causing disadvantages, such as, where the plurality of separation pawls 5 come into contact with the counterpart with impact thereby damaging the counterpart.

Figure 12A:
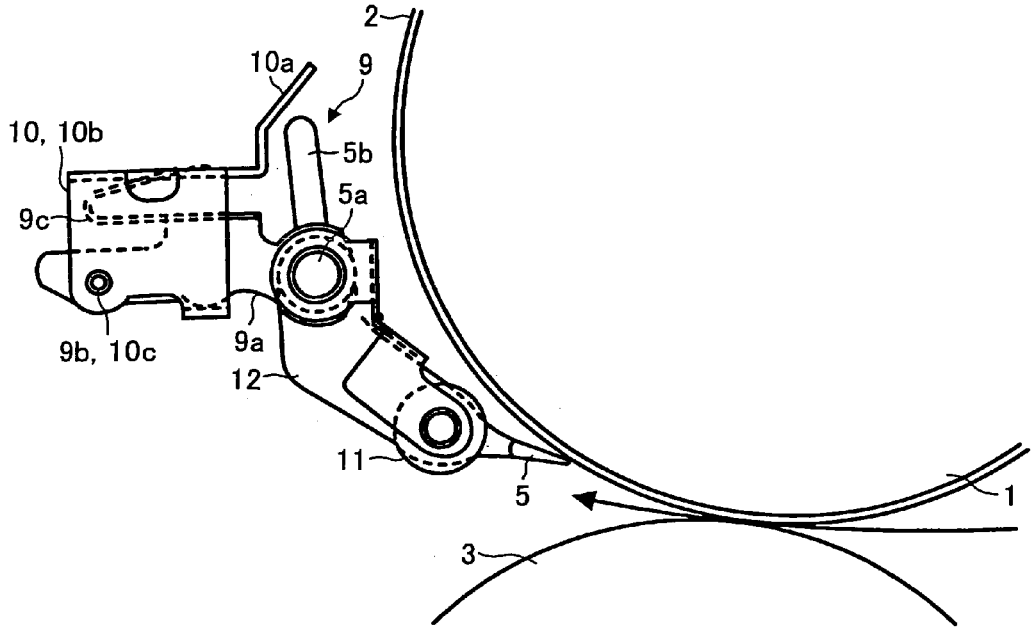
FIGS. 12A and 12B are sectional views illustrating operations of the separation pawls when the jam is caused by a wound sheet in the fixing device.
Figure 12B:
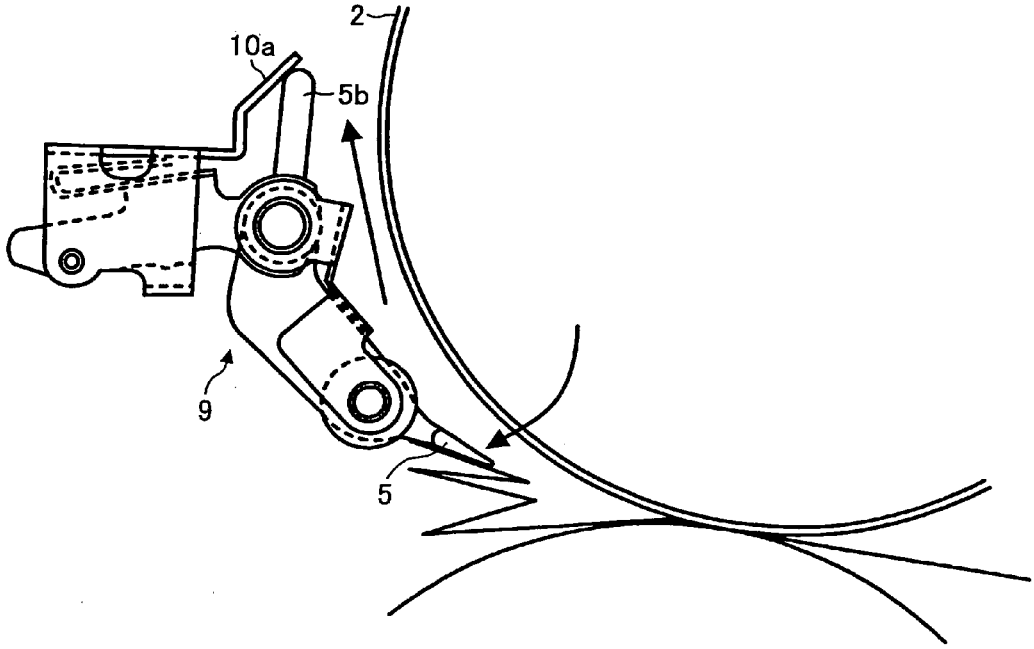

Referring now to FIGS. 12A and 12B, as illustrated in FIGS. 7 and 12A, each separation pawl unit 9 is equipped with the separation pawl 5, the rotation shaft 5*a* for the separation pawl 5, the projected bump piece 5*b* projected from the rotation shaft 5*a*, the separation pawl holder 9*a*, the plate spring 9*c* as the biasing member, the mounting portion 10 and the stopper 10*a*. As illustrated in FIGS. 6 and 12A, the plurality of the separation pawl units 9 are inserted into the mounting portions 10 provided on the bracket 6 to bias the respective separation pawl units 9 in a predetermined direction by using the plate springs 9*c*, so that the plurality of the separation pawls 5 can be held at predetermined positions with elasticity. On the other hand, each separation pawl unit 9 is capable of pivoting freely around the pair of engaging holes 9*b*.

Each separation pawl 5 pivots around the rotation shaft 5*a* on which the projected bump piece 5*b* is provided. The mounting portions 10 forming the bracket 6 as a part thereof are used for attaching the plurality of separation pawl units 9 to the bracket 6.

In addition, the stopper 10*a* for regulating a pivoting motion in a direction which tends to be in contact with the fixing belt 2 is provided on each mounting portion 10. When the plurality of separation pawls 5 are raised by the jammed recording sheet in the jam, the plurality of separation pawl units 9 pivot to separate the tips of the respective separation pawls 5 from the surface of the fixing belt 2, with the help of the stoppers 10*a*.

In each separation pawl unit 9, the separation pawl 5 pivots freely around the rotation shaft 5*a*, and the separation pawl unit 9 is equipped with the separation pawl holder 9*a*, which holds the separation pawl 5 with the help of the rotation shaft 5*a*. The separation pawl holder 9*a* is made of metal having sufficient elasticity to operate in the manner described and the separation pawl holder 9*a* has another center of rotation of the pair of engaging holes 9*b* besides the rotation shaft 5*a* around which the separation pawl 5 pivots.

Moreover, each separation pawl unit 9 is provided with the plate spring 9*c* for holding the separation pawl 5 and the separation pawl holder 9*a* at a predetermined position with the help of elasticity.

Typically, when the recording sheet indicated by a large arrow smoothly passes, the plurality of separation pawls 5 come in contact with the fixing belt 2 so as to prevent the recording sheet from winding around the fixing roller 2. When a jam occurs by a wound recording sheet, the recording sheet wound around the fixing belt 2 thrusts to raise the plurality of separation pawls 5 in a condition illustrated in FIG. 12B. In other words, when the recording sheet raises the plurality of separation pawls 5, the plurality separation pawls 5 are thrust in a direction in which the respective separation pawls 5 are acutely in contact with the fixing belt 2. However, at this time, the respective separation pawl holders 9*a* holding the respective separation pawls 5 pivot around the center of the pair of engaging holes 9*b* in a counterclockwise direction. Accordingly, the holders 12, the separation pawls 5, and the projected bump pieces 5*b* forming respective separation pawl holders 9*a* move in an upper left direction, in an integrated fashion, as illustrated in FIG. 12B, before the respective separation pawls 5 acutely come in contact with the fixing belt 2. That is to say, the holders 12, the separation pawls 5, and the projected bump pieces 5*b* forming the separation pawl holders 9*a* move in a direction indicated by a small arrow. Since the respective projected bump pieces 5*b* bump against the stoppers 10*a* of the mounting portions 10, in this case, the plurality of separation pawls 5 are prevented from moving in the internal direction in which the plurality of separation pawls 5 are acutely in contact with the fixing belt 2. Additionally, in this case, since the stopper 10*a* and the projected bump pieces 5*b* are bumped with each other, the plurality of separation pawls 5 pivots around the rotation shafts 5*a* in a clockwise direction. The above pivoting motion causes the tips of the plurality of separation pawls 5 to move in a direction so that the tips thereof are separated from the surface of the fixing belt 2.

With the above-described operations automatically performed, the disadvantages such as damage to the fixing belt 2 caused by the plurality of separation pawls 5 during a jam caused by the wound recording sheet can be eliminated.

Although, in the example of the embodiment according to the present invention, the nip part is configured to include the fixing belt 2 used as a mechanism for fixing and the heat roller 3 used as a mechanism for fixing so that the recording sheet can be separated in the condition in which the plurality of separation pawls 5 are in contact with the fixing belt 2, it should be noted that the mechanism for fixing and the mechanism for heating may be rollers. Additionally, when an endless belt is used as the fixing member and the heating member, a pressure roller pressing one endless belt to be in contact with the other endless belt is needed. In any case, in combination with the mechanism for fixing and a mechanism for pressing, the plurality of separation pawls 5 need to be configured in a manner that the plurality of separation pawls 5 come in contact with a surface of a particular mechanism, on which molten toner in the fixing process easily attaches, to separate the recording sheet.

In the above embodiment according to the present invention, since the fixing belt 2 presses and comes in contact with the toner image on the recording sheet, the plurality of separation pawls 5 are configured to come in contact with the surface of the fixing belt 2 so that the recording sheet can be easily adhered on the surface of the fixing belt 2. Accordingly, when a fixing roller is used instead of the fixing belt 2, the separation pawls 5 are required to be in contact with the surface of the fixing roller to separate the recording sheet.

Moreover, in the above embodiment according to the present invention, a heating method based on an induction heating method can be employed instead of the halogen heaters as the heat sources of the fixing roller 2, the auxiliary roller 2*a*, and the heat roller 3. According to the induction heating method, heat control with high accuracy can be achieved in addition to a heating operation with high thermal efficiency, so that high reliability in fixing the image with little thermal irregularity can be achieved.

In addition, according to the above embodiment of the present invention, although typical commercial power supply is used for power supply to the halogen heater, an auxiliary power source can be provided to supply the power, instead of the commercial power supply. For such an auxiliary power source, an electrical two-layered capacitor including an electro-chemical capacitor can preferably be used. According to the members or methods described above, there are such advantages that the fixing device can be powered on within a short period without limitation resulted from the commercial power supply. On the other hand, power consumption can be reduced. In addition, when the temperature goes out of control, security under thermal fluctuation can be ensured.

It should be noted that the present invention associated with the fixing device is widely applicable to a variety of devices that convey sheet-shaped materials, such as the recording sheet, and applicable to a variety of devices that supply heat to the sheet-shaped materials.

The present invention has been described above with reference to specific embodiments. Note that the present invention is not limited to the details of the embodiments described above, but various modifications and improvements are possible without departing from the spirits and scope of the invention.

What is claimed is:

1. An image forming apparatus comprising:

an image forming mechanism configured to form a toner image on a recording sheet; and a fixing mechanism comprising:

a pair of rotating members configured to form a nip portion and to fix the toner image onto the recording sheet with the nip under pressure and heat; and an ejection guide member configured to swing relative to the pair of rotating members, the ejection guide member comprising:

a bracket including an elastic member;

a supporting shaft configured to support the bracket and having a center axis about which the bracket is freely pivotable;

a plurality of separation pawl members provided on the bracket and configured to turn about a rotating shaft; and a pawl stopper provided on the bracket, the pawl stopper comprising a lever configured to move, and a pressing member configured to press the elastic member to pivot the bracket about the center axis when the lever is moved.

2. The image forming apparatus according to claim 1, wherein:

the ejection guide member is moved close to the nip portion and tips of the plurality of separation pawl members are pressed to a surface of one of the pair of rotating members by swinging the ejection guide member such that the pawl stopper is engaged with an engaging portion of the fixing mechanism in response to a motion of the lever in a fixing process; and the pressing member presses the elastic member of the bracket to cause the bracket to turn to move the ejection guide member away from the nip portion and the tips of the plurality of separation pawl members are separated from the surface of the one of the pair of rotating members by turning the pawl stopper in a direction to disengage from the engaging portion of the fixing mechanism in response to a different motion of the lever in a sheet jam recovery process.

3. The image forming apparatus according to claim 1, wherein a slant portion of the pawl stopper is kept in contact with the engaging portion of the fixing mechanism when the pressing member presses the elastic member of the bracket to cause the bracket to turn to move the ejection guide member away from the nip portion and the tips of the plurality of separation pawl members are separated from the surface of the one of the pair of rotation members by turning the pawl stopper in the direction to disengage from the engaging portion of the fixing mechanism in response to a different motion of the lever in a sheet jam recovery process.

4. The image forming apparatus according to claim 1, wherein each of the plurality of separation pawl members comprises:

a separation pawl; and a separation pawl holder including a pressing member for pressing the separation pawl in the direction in which the tips of the plurality of separation pawl members are pressed to the surface of the one of the pair of rotating members and configured to hold the separation pawl for rotation relative to the rotating shaft, wherein the bracket comprises:

a plurality of mounting portions configured to mount the plurality of separation pawl members with the plurality of respective separation pawl holders such that the plurality of separation pawl holders are pivotable about the plurality of respective mounting portions, and each of the plurality of mounting portions comprising a stopper configured to regulate a movement of the separation pawl in the direction in which the tips of the plurality of separation pawl members are pressed to the surface of the one of the pair of rotating members.

5. The image forming apparatus according to claim 4, wherein the rotating shaft includes a protrusion that is configured to engage with the stopper when the separation pawl is lifted up due to a jam of the recording sheet so that the tips of the plurality of separation pawl members are separated from the one of the pair of rotating members by at least a predetermined distance when a recording sheet jam occurs.

6. The image forming apparatus according to claim 5, wherein each of the plurality of separation pawl members further comprises:

a sub-holder configured to share the rotating shaft with the separation pawl holder; and a roller held by the sub-holder at a portion close to the separation pawl and configured to rotate by friction generated by contact with the recording sheet and to guide the recording sheet for ejection after completion of the fixing process.

7. The image forming apparatus according to claim 5, wherein the ejection guide member further comprises:

an idle roller configured to be kept contact with the surface of the one of the pair of rotating members during the fixing process and to allow the ejection guide member to swing about the center axis when kept contact with the surface of the one of the pair of rotating members during a process of disengagement of the ejection guide member.

8. An image forming apparatus comprising:

means for forming a toner image on a recording sheet;

means for fixing the toner image onto the recording sheet with a nip under pressure and heat; and means for ejecting the recording, the means for ejecting being configured to swing relative to the means for fixing, the means for ejecting comprising:

plural means for separating the recording sheet turning about a rotating shaft;

means for holding the plural means for separating including means for being pressed;

means for supporting the means for holding and having a center axis about which the means for holding is freely pivotable; and means for engaging provided on the means for holding, the means for engaging comprising means for allowing the means for engaging to turn, and means for pressing the means for being pressed to pivot the means for holding about the center axis when the means for engaging is turned.

9. A fixing mechanism comprising:

a pair of rotating members configured to form a nip portion and to fix the toner image onto the recording sheet with the nip under pressure and heat; and an ejection guide member configured to swing relative to the pair of rotating members, the ejection guide member comprising:

a bracket including an elastic member;

a supporting shaft configured to support the bracket and having a center axis about which the bracket is freely pivotable;

a plurality of separation pawl members provided on the bracket and configured to turn about a rotating shaft; and a pawl stopper provided on the bracket, the pawl stopper comprising a lever configured to move, and a pressing member configured to press the elastic member to pivot the bracket about the center axis when the lever is moved.

10. The fixing mechanism according to claim 9, wherein:

the ejection guide member is moved close to the nip portion and tips of the plurality of separation pawl members are pressed to a surface of one of the pair of rotating members by swinging the ejection guide member such that the pawl stopper is engaged with an engaging portion of the fixing mechanism in response to a motion of the lever in a fixing process, and the pressing member presses the elastic member of the bracket to cause the bracket to turn to move the ejection guide member away from the nip portion and the tips of the plurality of separation pawl members are separated from the surface of the one of the pair of rotating members by turning the pawl stopper in a direction to disengage from the engaging portion of the fixing mechanism in response to a different motion of the lever in a sheet jam recovery process.

11. The fixing mechanism according to claim 9, wherein a slant portion of the pawl stopper is kept in contact with the engaging portion of the fixing mechanism when the pressing member presses the elastic member of the bracket to cause the bracket to turn to move the ejection guide member away from the nip portion and the tips of the plurality of separation pawl members are separated from the surface of the one of the pair of rotation members by turning the pawl stopper in the direction to disengage from the engaging portion of the fixing mechanism in response to a different motion of the lever in a sheet jam recovery process.

12. The fixing mechanism according to claim 9, wherein each of the plurality of separation pawl members comprises:

a separation pawl; and a separation pawl holder including a pressing member for pressing the separation pawl in the direction in which the tips of the plurality of separation pawl members are pressed to the surface of the one of the pair of rotating members and configured to hold the separation pawl for rotation relative to the rotating shaft, wherein the bracket comprises:

a plurality of mounting portions configured to mount the plurality of separation pawl members with the plurality of respective separation pawl holders such that the plurality of separation pawl holders are pivotable about the plurality of respective mounting portions, and each of the plurality of mounting portions comprising a stopper configured to regulate a movement of the separation pawl in the direction in which the tips of the plurality of separation pawl members are pressed to the surface of the one of the pair of rotating members.

13. The fixing mechanism according to claim 12, wherein the rotating shaft includes a protrusion that is configured to engage with the stopper when the separation pawl is lifted up due to a jam of the recording sheet so that the tips of the plurality of separation pawl member are separated from the one of the pair of rotating members by at least a predetermined distance when a recording sheet jam occurs.

14. The fixing mechanism according to claim 13, wherein each of the plurality of separation pawl members further comprises:

a sub-holder configured to share the rotating shaft with the separation pawl holder; and a roller held by the sub-holder at a portion close to the separation pawl and configured to rotate by friction generated by contact with the recording sheet and to guide the recording sheet for ejection after completion of the fixing process.

15. The fixing mechanism according to claim 9, wherein the ejection guide member further comprises:

an idle roller configured to be kept contact with the surface of the one of the pair of rotating members during the fixing process and to allow the ejection guide member to swing about the center axis when kept contact with the surface of the one of the pair of rotating members during a process of disengagement of the ejection guide member.

* * * * *